US012232557B2

(12) United States Patent
Melofchik et al.

(10) Patent No.: US 12,232,557 B2
(45) Date of Patent: Feb. 25, 2025

(54) HELMET WITH VENTILATION CONTROL

(71) Applicant: BERN UNLIMITED INC., Marshfield, MA (US)

(72) Inventors: Ryan Melofchik, San Diego, CA (US); Dennis J. Leedom, Duxbury, MA (US)

(73) Assignee: BERN UNLIMITED INC., Marshfield, MA (US)

( * ) Notice: Subject to any disclaimer, the term of this patent is extended or adjusted under 35 U.S.C. 154(b) by 74 days.

(21) Appl. No.: 18/063,437

(22) Filed: Dec. 8, 2022

(65) Prior Publication Data

US 2023/0180880 A1 Jun. 15, 2023

Related U.S. Application Data

(60) Provisional application No. 63/265,258, filed on Dec. 10, 2021.

(51) Int. Cl.
*A42B 3/28* (2006.01)

(52) U.S. Cl.
CPC ..... *A42B 3/281* (2013.01)

(58) Field of Classification Search
CPC ..... A42B 3/064; A42B 3/281; A42B 3/283
See application file for complete search history.

(56) References Cited

U.S. PATENT DOCUMENTS

| | | | | |
|---|---|---|---|---|
| 7,975,320 | B2 * | 7/2011 | Muskovitz | A42B 3/283 2/410 |
| 9,675,129 | B2 * | 6/2017 | Leedom | A42B 3/283 |
| 10,433,611 | B2 * | 10/2019 | Chen | A42B 3/281 |
| 2012/0180199 | A1 * | 7/2012 | Chilson | A42B 3/32 2/171.2 |
| 2015/0250253 | A1 * | 9/2015 | Jacobsen | A42B 3/221 2/411 |
| 2016/0150845 | A1 * | 6/2016 | Leedom | A42B 3/283 2/410 |
| 2019/0029356 | A1 * | 1/2019 | Michel | A42B 3/24 |
| 2019/0174861 | A1 * | 6/2019 | Fritzell | A42B 3/283 |
| 2023/0069274 | A1 * | 3/2023 | Pritz | A42B 3/06 |

FOREIGN PATENT DOCUMENTS

DE 4205842 C1 3/1993

OTHER PUBLICATIONS

International Search Report and Written Opinion from corresponding International Application No. PCT/US2022/052272 dated Apr. 4, 2023.

* cited by examiner

*Primary Examiner* — Katherine M Moran
(74) *Attorney, Agent, or Firm* — Lando & Anastasi, LLP

(57) ABSTRACT

A helmet comprises a shell defining a shell ventilation aperture and an inner liner securable within the shell. The inner liner defines an inner liner ventilation aperture and a recessed track. A ventilation control includes a slider plate and a boss disposed on the slider plate. The boss is configured to be frictionally retained within the recessed track while providing for the slider plate to be reversibly displaced along the recessed track from a first position in which the slider plate blocks a flow of air through the inner liner ventilation aperture to a second position in which the slider plate permits the flow of air through the inner liner ventilation aperture. The slider plate is configured to be reversibly displaced between the first and second position by a force applied upon a lower surface of the slider plate from within the helmet.

18 Claims, 10 Drawing Sheets

HELMET WITH VENTILATION CONTROL

CROSS-REFERENCE TO RELATED APPLICATIONS

This application claims priority under 35 U.S.C. § 119 (e) to U.S. Provisional Patent Application Ser. No. 63/265,258, titled "HELMET WITH VENTILATION CONTROL," filed Dec. 10, 2021, the entire contents of which is incorporated herein by reference for all purposes.

BACKGROUND

1. Technical Field

Aspects and embodiments disclosed herein are directed generally to helmets, and more particularly to sports helmets including ventilation features and control features for same.

2. Discussion of Related Art

Sports helmets are used in many sports for protecting the head of a wearer. Such sports may include, for example, biking, skiing, hockey, lacrosse, and football, and so-called "extreme sports" which may include snowboarding, rock or ice climbing, and skydiving.

In some examples, a sports helmet may include an outer shell designed to provide strength and rigidity for impact resistance and an inner pad mounted to an inner surface of the outer shell and configured to contact the head of a wearer. A sports helmet may protect the head of a wearer by providing impact resistance and/or by absorbing shocks when the helmet is impacted. The outer shell of a sports helmet is, in some examples, made of rigid material such as a hard plastic to facilitate impact resistance, for example, to distribute a force from a point impact across a large area of the shell of the helmet, while the inner pad is made of a resilient shock-absorbing material such as a polymeric foam.

In some examples, sports helmets include one or more ventilation openings which may provide for air to pass through the outer shell and inner pad of the helmet to assist in the dissipation of heat from the head of a wearer of the helmet.

SUMMARY

In accordance with one aspect, there is provided a helmet. The helmet comprises a shell including an outer surface and an inner surface, the shell defining a shell ventilation aperture passing from the outer surface of the shell to the inner surface of the shell, an inner liner securable within the shell, the inner liner defining an inner liner ventilation aperture that aligns with the shell ventilation aperture when the inner liner is secured within the shell, the inner liner further defining a recessed track in an inner surface of the inner liner, and a ventilation control including a slider plate and a boss disposed on an upper surface of the slider plate, the boss configured to be frictionally retained within the recessed track while providing for the slider plate to be reversibly displaced along the recessed track from a first position in which the slider plate blocks a flow of air through the inner liner ventilation aperture to a second position in which the slider plate permits the flow of air through the inner liner ventilation aperture, the slider plate configured to be reversibly displaced between the first position and the second position by a force applied upon a lower surface of the slider plate from within an internal volume of the helmet.

In some embodiments, the slider plate is not displaceable between the first and second positions from outside of the helmet.

In some embodiments, the ventilation control is configured to maintain a position in one of the first position, the second position, and an intermediate position between the first position and the second position in the absence of a force applied by a user of the helmet to the slider plate.

In some embodiments, the shell and inner liner each include a plurality of air flow apertures, the plurality of air flow apertures of the shell being aligned with the plurality of air flow apertures of the inner liner when the inner liner is secured within the shell.

In some embodiments, the slider plate includes a plurality of petals, the plurality of petals configured to block air flow through a subset of the plurality of air flow apertures of the inner liner when the slider plate is disposed in the first position.

In some embodiments, the subset of the plurality of air flow apertures of the inner liner include air flow apertures disposed on a top portion of the helmet.

In some embodiments, the shell and inner liner each include front and rear air flow apertures, the front and rear air flow apertures of the shell being aligned with the front and rear air flow apertures of the inner liner when the inner liner is secured within the shell, the front and rear air flow apertures of the inner shell permitting flow of air through the helmet when the slider plate is disposed in the first position.

In some embodiments, the helmet further comprises a cushion disposed on the lower surface of the slider plate.

In some embodiments, the inner liner further defines a second recessed track in the inner surface of the inner liner and the slider plate includes a plurality of bosses disposed on the upper surface of the slider plate, a first subset of the plurality of bosses configured to be frictionally retained within the recessed track and a second subset of the plurality of bosses configured to be frictionally retained within the second recessed track.

In some embodiments, the inner liner comprises a plurality of ribs defining a plurality of air flow channels that provide paths for air flow through the helmet.

In some embodiments, the plurality of air flow channels provide paths for air flow through the helmet in both a front to rear direction and a side to side direction.

In some embodiments, the plurality of air flow channels include air flow channels disposed in a lower front surface of the inner liner and configured to draw air from goggles worn by a user of the helmet while the user wears both the goggles and helmet.

In accordance with another aspect, there is provided a ventilation control system for a helmet. The ventilation control system comprises a slider plate and a boss disposed on an upper surface of the slider plate, the boss configured to be frictionally retained within recessed track defined within an inner surface of a liner of the helmet while providing for the slider plate to be reversibly displaced along the recessed track from a first position in which the slider plate blocks a flow of air through a ventilation aperture defined in the inner liner to a second position in which the slider plate permits the flow of air through the ventilation aperture, the slider plate configured to be reversibly displaced between the first position and the second position by a force applied upon a lower surface of the slider plate from within an internal volume of the helmet.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
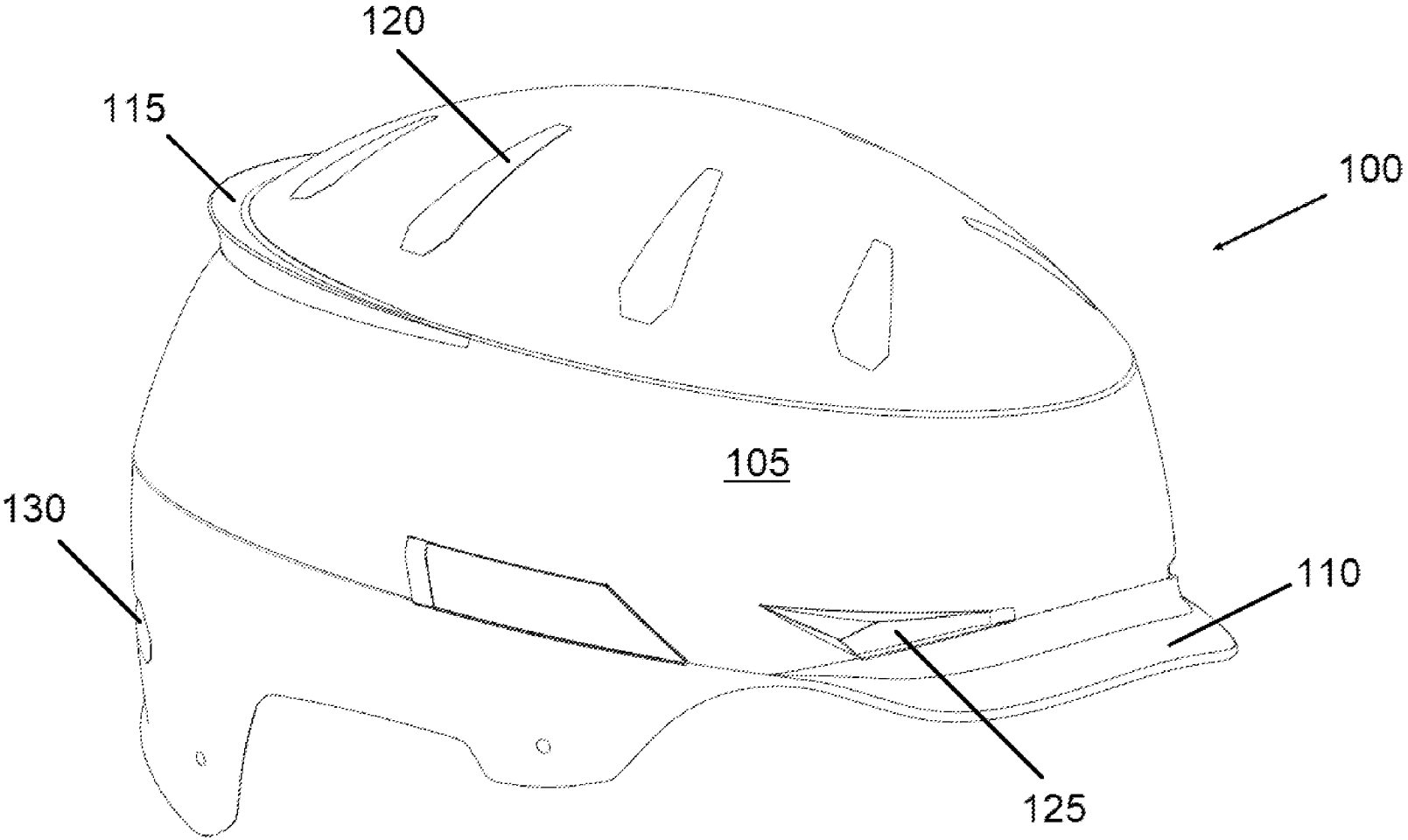
FIG. 1 is a perspective view of an embodiment of a helmet.

Aspects and embodiments disclosed herein are not limited to the details of construction and the arrangement of components set forth in the following description or illustrated in the drawings. The disclosed aspects and embodiments are capable of being practiced or of being carried out in various ways. Also, the phraseology and terminology used herein is for the purpose of description and should not be regarded as limiting. The use of "including," "comprising," "having," "containing," "involving," and variations thereof herein is meant to encompass the items listed thereafter and equivalents thereof as well as additional items.

The present disclosure will be described with reference to sports helmets, referred to herein synonymously as "sports helmets" or simply "helmets," although it should be understood that aspects and embodiments disclosed herein may equally apply to other forms of headgear or helmets, for example, hard hats, uniform hats, baseball caps, and other forms of head gear.

It is often desirable to a wearer of a helmet that the helmet provide sufficient protection to the head of the wearer to justify any inconvenience associated with wearing the helmet. A wearer may desire that a helmet provide both impact resistance and shock absorbance protection appropriate for the form of activity which the wearer wishes to engage in while wearing the helmet. The degree of protection a helmet offers a wearer may in some examples be required to satisfy certain minimum standards for the helmet to be approved by an approval body for use in different activities.

Wearers of helmets are often concerned with more than just the protective aspects of a helmet when selecting a helmet for use while participating in their activity of choice. For example, aesthetics may play a role in a decision of a potential buyer to purchase a particular helmet. Some potential purchasers may be attracted to helmets that are sleek, streamlined, and aerodynamic, rather than bulky and poorly proportioned. Some potential purchasers may also, or alternatively, be attracted to helmets that they believe will be rugged and resistant to damage. Thus, potential purchasers may be attracted to helmets which include few external features extending or protruding from an outer surface of the helmet. The provision of few, if any, external features extending or protruding from an outer surface may provide the helmet with a more sleek and streamlined look, may provide for the helmet to have a thinner, lower profile, and may reduce the number of external features which may be subject to damage upon, for example, impact of the helmet with an object, which may snag material which the helmet may come into contact with, and/or which may add weight or manufacturing cost to the helmet.

Potential purchasers may consider it desirable that a helmet include ventilation apertures that allow for the flow of air into or out of the helmet to facilitate cooling of the head of a wearer and/or evaporation of sweat from the head of the wearer during use. These purchasers may consider it an added benefit if the ventilation apertures may be reversibly opened and closed so that the helmet may be used with the ventilation apertures closed on cold days when cooling is not necessary and with the ventilation apertures opened on warmer days when ventilation and cooling is desired. It may be desirable that the ventilation apertures or ventilation system of a helmet be easily switched from an open to a closed position, but resistant to unintentional switching between open and closed positions, for example, when the helmet is in use. It may also be desirable that the ventilation apertures or ventilation control system of a helmet may be set to one or more intermediate positions between fully opened and fully closed.

Both potential purchasers and manufacturers of helmets may also desire helmets that have few independent parts, moving or otherwise, with acceptable degrees of tolerances between the parts, when assembled, so that the manufacturing and use of the helmet is simple and inexpensive. The provision of a fewer rather than a greater number of parts in a helmet ventilation control system may also desirably reduce the overall weight of a helmet.

Aspects and embodiments disclosed herein may address one or more of the concerns and/or desires described above.

Various aspects and embodiments disclosed herein include a helmet having a ventilation system including ventilation apertures and a ventilation control which is easily operable, resistant to unintentional switching between open and closed positions (or from a partially open position), and which does not disturb an otherwise sleek and aerodynamic shape of an external surface of the helmet. Aspects and embodiments of the helmets disclosed herein include one or more ventilation apertures passing through shells of the helmets. The ventilation apertures are selectively opened and closed, or set to a partially opened configuration which in some embodiments may be any position desirable between a fully open and fully closed configuration, by a ventilation control. The ventilation control may reside entirely internal to the outer shell of the helmet and be free of actuators or other features extending from the outer surface of the helmet where they may disturb the aesthetics and/or aerodynamics of the helmet or result in the other disadvantages discussed above.

The ventilation control may be operable from within the helmet but not from outside of the helmet. In some embodiments, the ventilation control is accessible and operable prior to a user putting on a helmet and/or upon removal of the helmet from the user's head but not while the user is wearing the helmet.

The ventilation control may include a feature which slides into a first position allowing air to pass through one or more ventilation apertures in the helmet and into a second position blocking air from flowing through the one or more ventilation apertures. The feature may also slide into one or more intermediate positions between the first position and the second position, partially obstructing flow of air through the one or more ventilation apertures. The sliding feature may encounter sufficient friction against other parts of the helmet when in the first and/or second and/or intermediate position such that it is resistant to movement from the position in which it is set absent a manual force applied by the user of the helmet.

A perspective view of a helmet 100 in accordance with various aspects and embodiments disclosed herein is shown in FIG. 1. The helmet 100 includes an outer shell 105. The outer shell 105 may be formed of a rigid polymer, for example, acrylonitrile butadiene styrene (ABS), or a composite including fiberglass or carbon fibers disposed in a matrix material, for example, epoxy. The outer shell 105 may include a visor 110 and a spoiler 115 to give the helmet 100 a sleek aerodynamic look. The spoiler 115 may also provide benefits such as reduction of drag, increased stability, or provision of a downward force on a user wearing the helmet 100 during travel.

Figure 2:
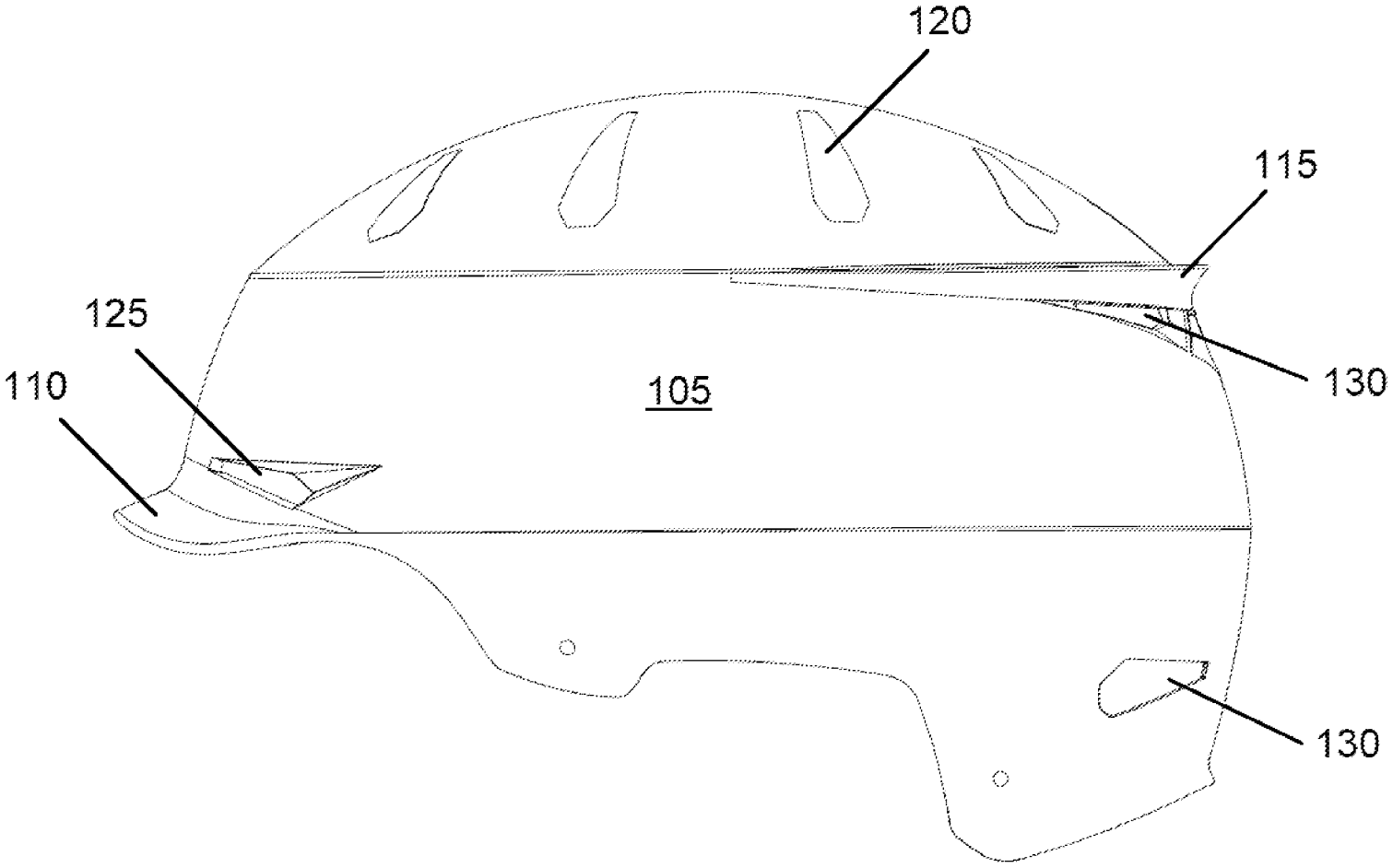
FIG. 2 is an elevational view from the side of the helmet of FIG. 1.
Figure 3:
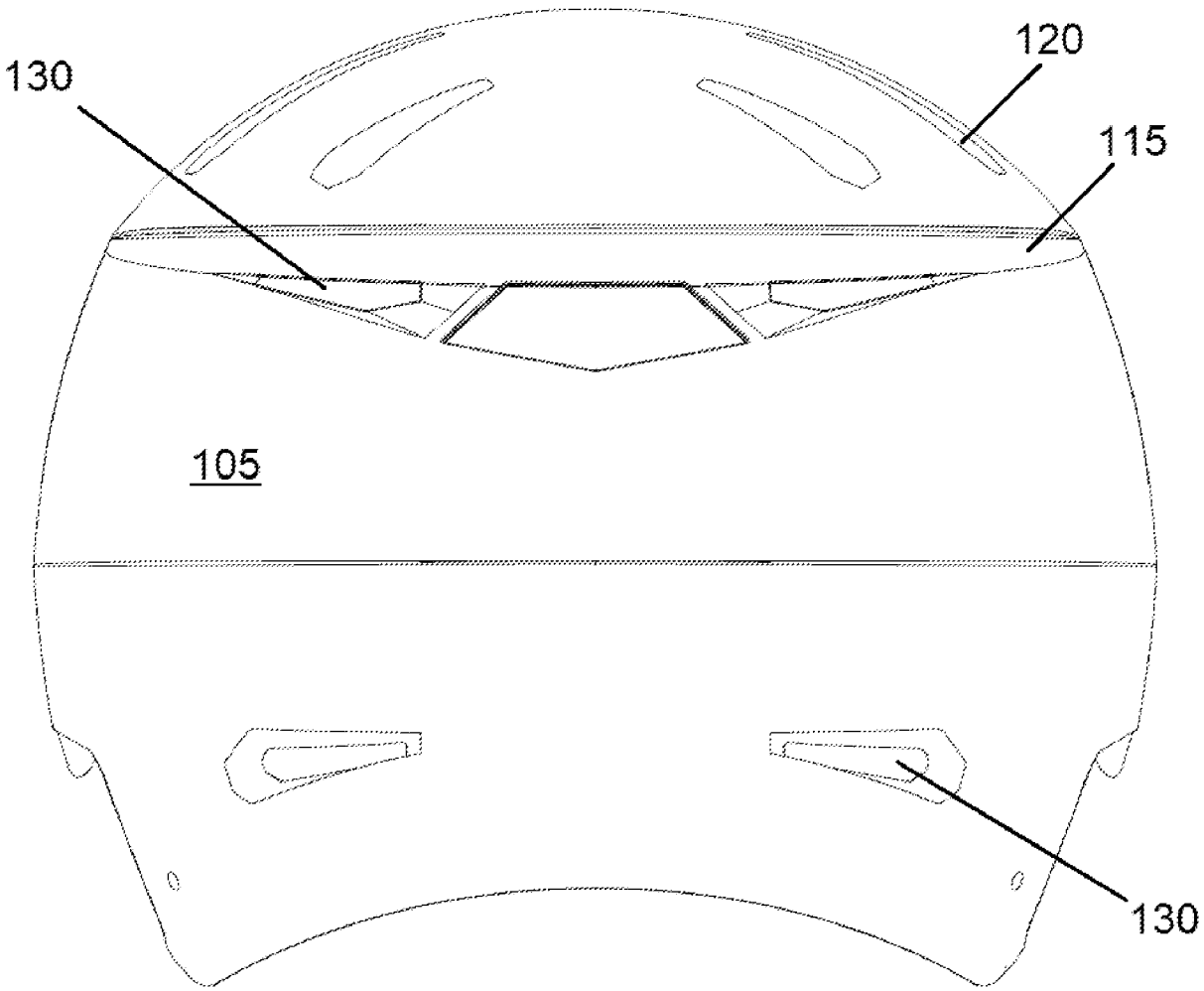
FIG. 3 is an elevational view from the rear of the helmet of FIG. 1.

One or more ventilation apertures are defined in the shell 105 of the helmet 100. The ventilation apertures may include top apertures 120 defined in an upper surface of the helmet 100 as well as front apertures 125 defined in a front surface and rear apertures 130 defined in a rear surface of the shell 105 of the helmet 100 proximate the rear base of the helmet 100. The ventilation apertures are defined by openings formed in the outer shell 105. The ventilation apertures allow for air to pass through the shell 105 of the helmet 100 to cool the head of a wearer of the helmet 100 and/or allow sweat or water vapor to pass form the wearer's head out through the body or shell of the helmet. The front and rear apertures 125, 130 may allow for air to flow into, through, and out of the helmet when the wearer of the helmet is in motion. As illustrated in the side view of the helmet in FIG. 2 and the rear view of the helmet in FIG. 3, additional rear apertures 130 may be defined in the shell 105 below and proximate the base of the spoiler 115.

Figure 4:
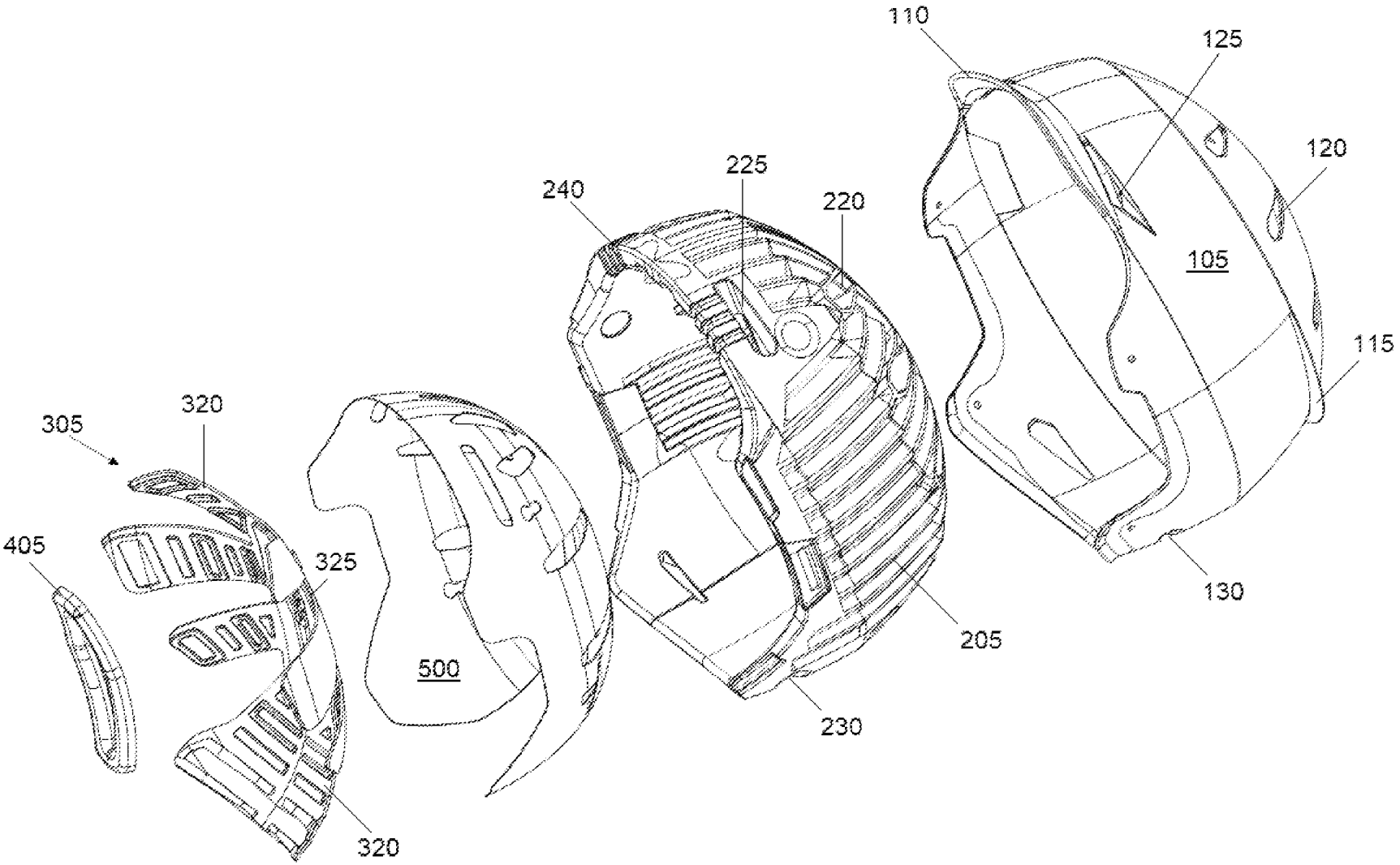
FIG. 4 is an exploded view of the helmet of FIG. 1.
Figure 5:
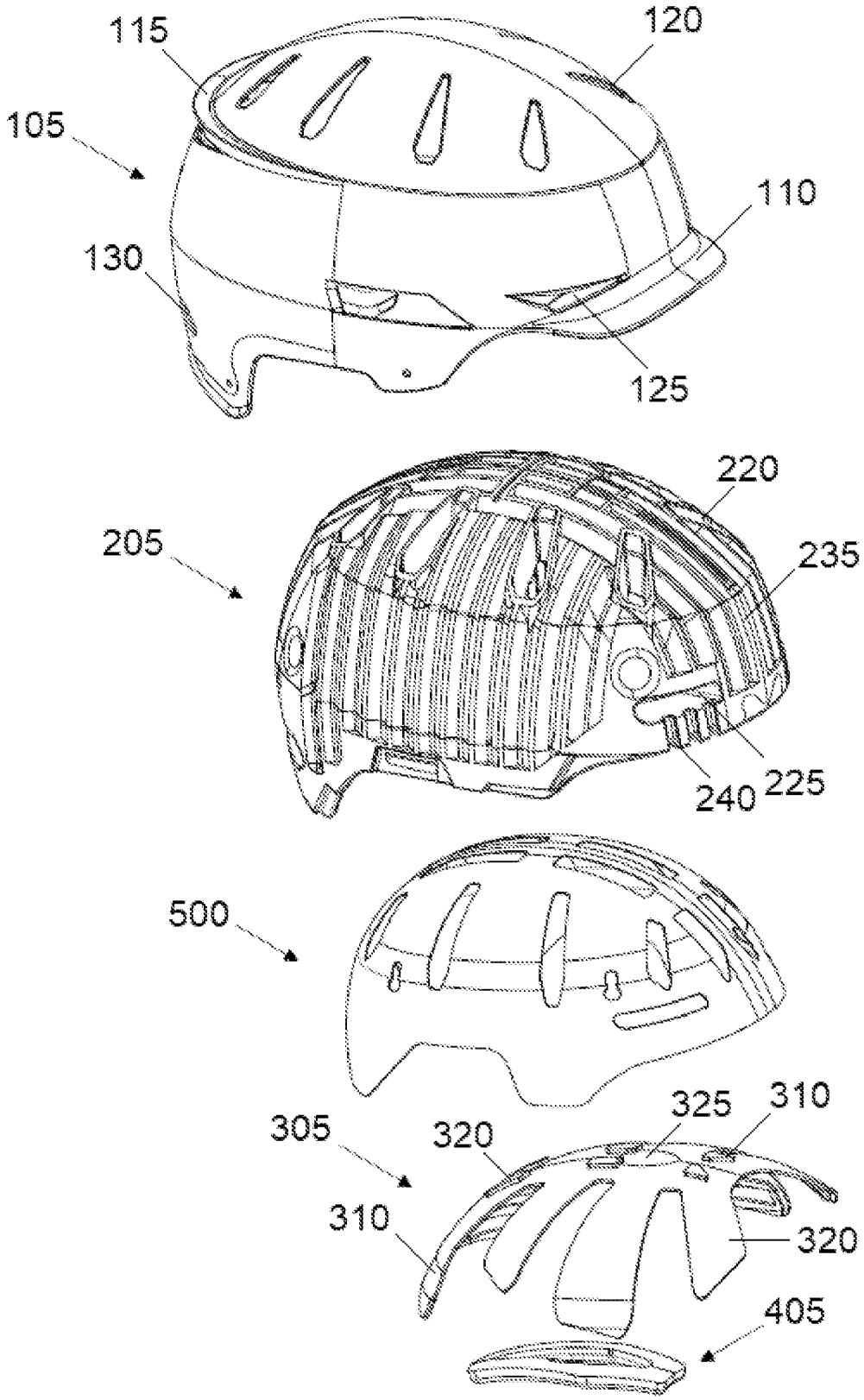
FIG. 5 is another exploded view of the helmet of FIG. 1.

An exploded view of the helmet 100 is provided in FIGS. 4 and 5. Visible in FIGS. 4 and 5 is an inner liner 205 of the helmet. The inner liner 205 is shaped to conform to the internal shape of the shell 105 and may be removably affixed within the shell 105 with fasteners, for example, snaps or hook and loop fasteners, or, in other embodiments, may be fixedly secured within the shell 105 with an adhesive. The inner liner 205 is designed to absorb impact energy that may be applied to the helmet should the wearer of the helmet strike the helmet against an obstacle. The inner liner 205 is formed of a material that will deform and absorb impact energy, for example, expanded polystyrene or another appropriate material. The inner liner 205 includes top, front, and rear apertures 220, 225, 230 that align with the top, front, and rear apertures 120, 125, 130 of the shell 105 when the inner liner 205 is disposed in the shell 105 to provide for airflow through the apertures 120, 125, 130 and 220, 225, 230. The inner liner 205 is formed with a plurality of ribs 235 on its outer surface aligned both front to back and side to side that provide additional ventilation pathways for air to travel through the helmet 100 to cool the head of a wearer of the helmet 100. Additional ventilation channels 240 are defined in a lower front surface of the inner liner 205. These ventilation channels 240 are positioned to align with the tops of goggles that a wearer of the helmet may also wear while wearing the helmet. Air flow though the ventilation pathways defined by the front and rear apertures 125, 225, 130, 230 and ribs 235 may create a venturi effect that draws air out of the top of a user's goggles and through ventilation channels 240 to help reduce or eliminate fogging of the user's goggles.

The helmet 100 also includes a slider plate 305 that functions as a ventilation control that a user may manipulate to selectively cover or uncover the top apertures 120, 220 to either block or allow air to flow into or out of the helmet through the top apertures 120, 220. In some embodiments, the slider plate 305 may also selectively cover or uncover the front apertures 125, 225 and/or rear apertures 130, 230 to either block or allow air to flow into or out of the helmet through the front apertures 125, 225 and/or rear apertures 130, 230. In other embodiments, the slider plate will not selectively cover or uncover the front apertures 125, 225 and the front apertures may remain unblocked regardless of the position of the slider plate 305. In some embodiments, the rear apertures 130, 230 are not blocked by the slider plate 305 regardless of the position of the slider plate 305.

The slider plate 305 includes a plurality of petals 320 joined together at a central portion 325. The slider plate 305 has a curvature or is sufficiently deformable to conform to the curvature of the internal surface on the inner liner 205. As described further below, each of the petals 320 may selectively cover or uncover one or more of the top apertures 120, 220. As visible in FIG. 5, the top surface of the slider plate 305 includes a plurality of bosses 310 that engage with an internal surface of the inner liner 205 to slidably secure the slider plate 305 to the inner liner, as described in further detail below. Six bosses 310 are illustrated in FIG. 5 but in other embodiments, fewer, for example, two elongated bosses or more than six bosses may be provided and may be shaped differently than in the example illustrated in FIG. 5. In some embodiments, the slider plate 305 may be sufficiently stiff so as not to easily bend away from the top apertures 120, 220 when blocking the top apertures 120, 220 to avoid unintentionally allowing air to flow through the top apertures 120, 220. The slider plate may be formed of a stiff closed cell foam, for example, compression molded ethylene-vinyl acetate (EVA). The bosses 310 may be formed of a different, more deformable and resilient material than the slider plate 305, for example, a more rigid form of EVA than used to form to plate portion of the slider plate 305 to facilitate frictional engagement with recessed tracks 245F, 245M, 24R (collectively referred to herein as recessed tracks 245) on the internal surface of the inner liner 205.

A coffin-shaped pad 405 is disposed on the lower surface of the slider plate 305 in the central portion 325 and is located and shaped to rest against the top of a user's head when wearing the helmet 100 to enhance user comfort. The pad 405 may be formed of a soft resilient material, for example, open cell polyurethane foam covered in a fabric liner.

The helmet may further include a low friction layer 500 that fits into the inner volume of the inner liner 205 between the inner surface of the inner liner 205 and the slider plate 305. The low friction layer 500 provides for the mitigation of rotational forces during impacts. This part also has holes in it positioned where the slider channels 425 are in the inner liner 205, such that the bosses 310 of the slider plate 305 can pass through it. This component may be attached to the inner liner at four anchor points molded into the inner liner and affixed with elastomeric bands. In some embodiments, the low friction layer 500 is or includes a Mips® safety system.

Figure 6:
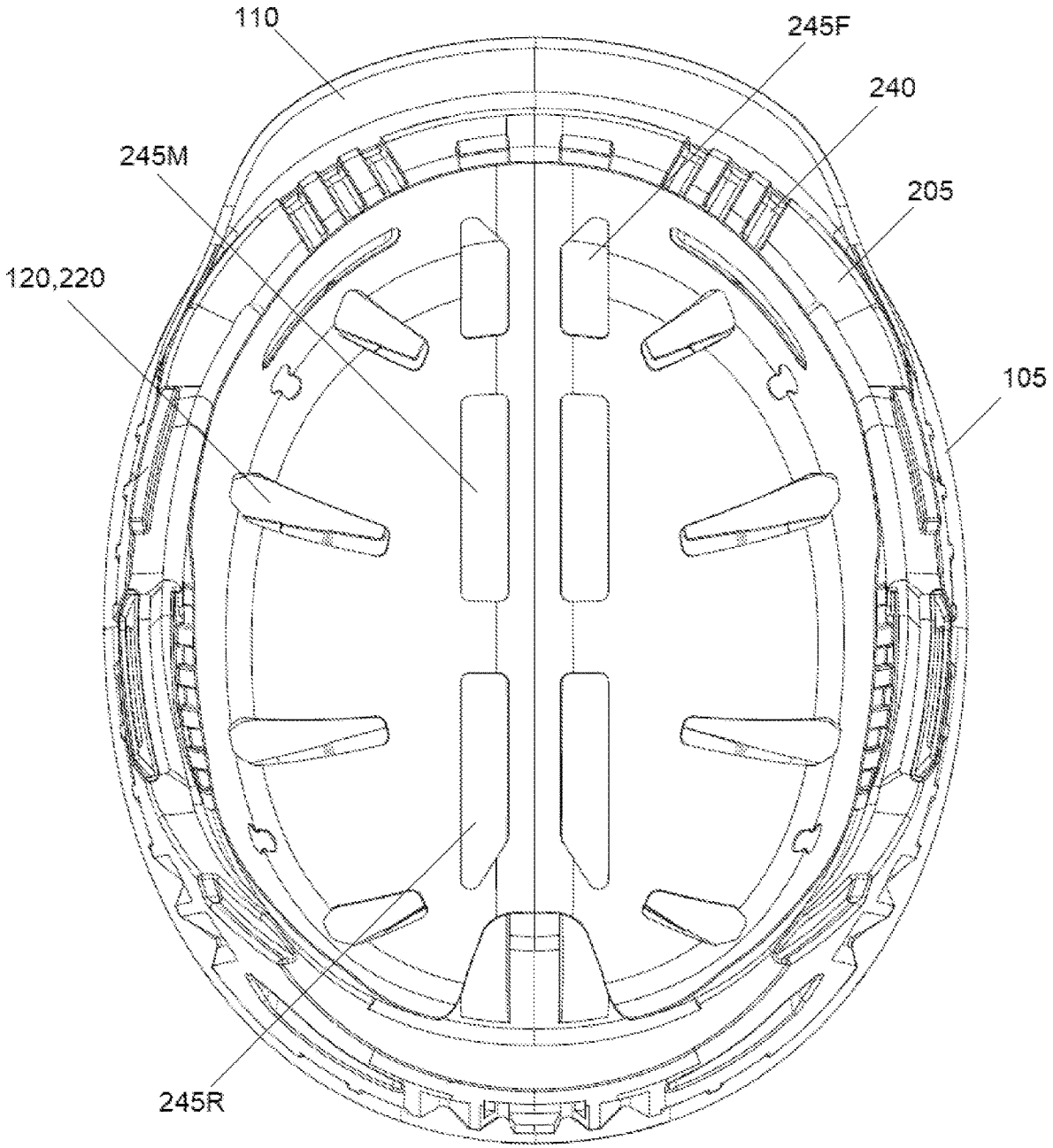
FIG. 6 illustrates an inner surface of an inner liner of the helmet of FIG. 1.

A view of the inside of the helmet 100 with the inner liner 205, but not the slider plate 305, installed is shown in FIG. 6. As illustrated in FIG. 6, three pairs of recessed tracks 245 including a front pair 245F, a middle pair 245M, and a rear pair 245R of recessed tracks are defined in the internal surface of the inner liner 205. The recessed tracks 245 are recessed portions of the internal side of the inner liner 205 sized to receive the bosses 310 attached to the slider plate 305. The bosses 310 form a friction fit within the recessed tracks 245, as illustrated in cross-section in FIG. 9 (a cross-section through line 9-9 of FIG. 7), that keeps the slider plate 305 engaged with the inner liner 205. The friction fit is not so tight as to render the slider plater 305 and bosses 310 immovable relative to the inner liner 205, but rather allows for a user to manually displace the slider plater 305 and bosses 310 along the lengths of the recessed tracks 245 to selectively cover or uncover the ventilation apertures 120, 220 with the slider plate 305 as illustrated in FIGS. 7 and 8.

Although three pairs of recessed tracks are illustrated in FIG. 6, in other embodiments the front 245F, middle 245M, and rear 245R recessed tracks on each side of the helmet may be joined so that there are two parallel recessed tracks running from front to back of the internal surface of the inner liner.

Figure 10:
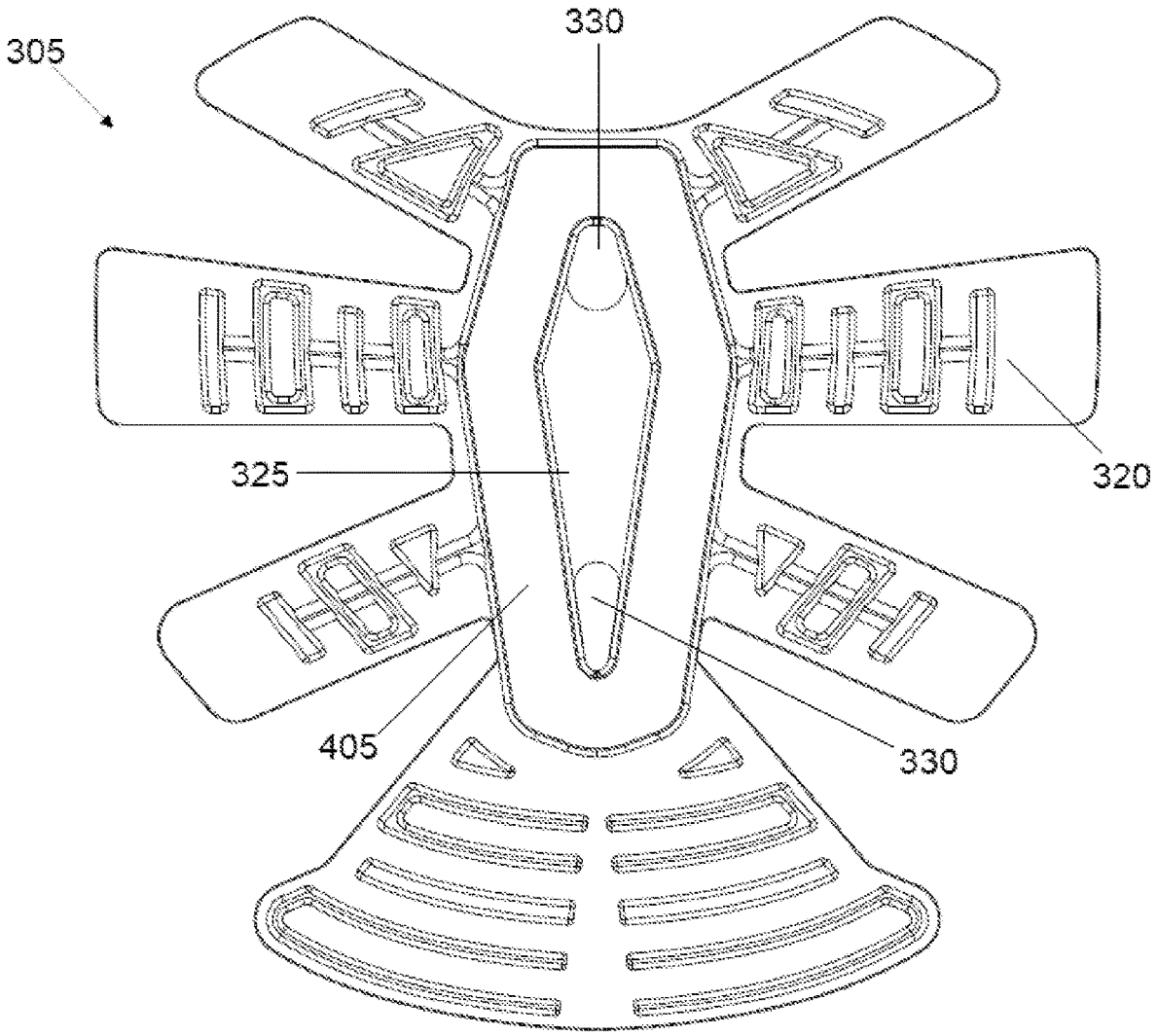
FIG. 10 illustrates an embodiment of a slider plate for use with helmets as disclosed herein.

In some embodiments, as illustrated in FIG. 10, the slider plate 305 may include one or more finger holes 330 to facilitate movement of the slider plate 305 along the recessed tracks 245 by a user.

Figure 7:
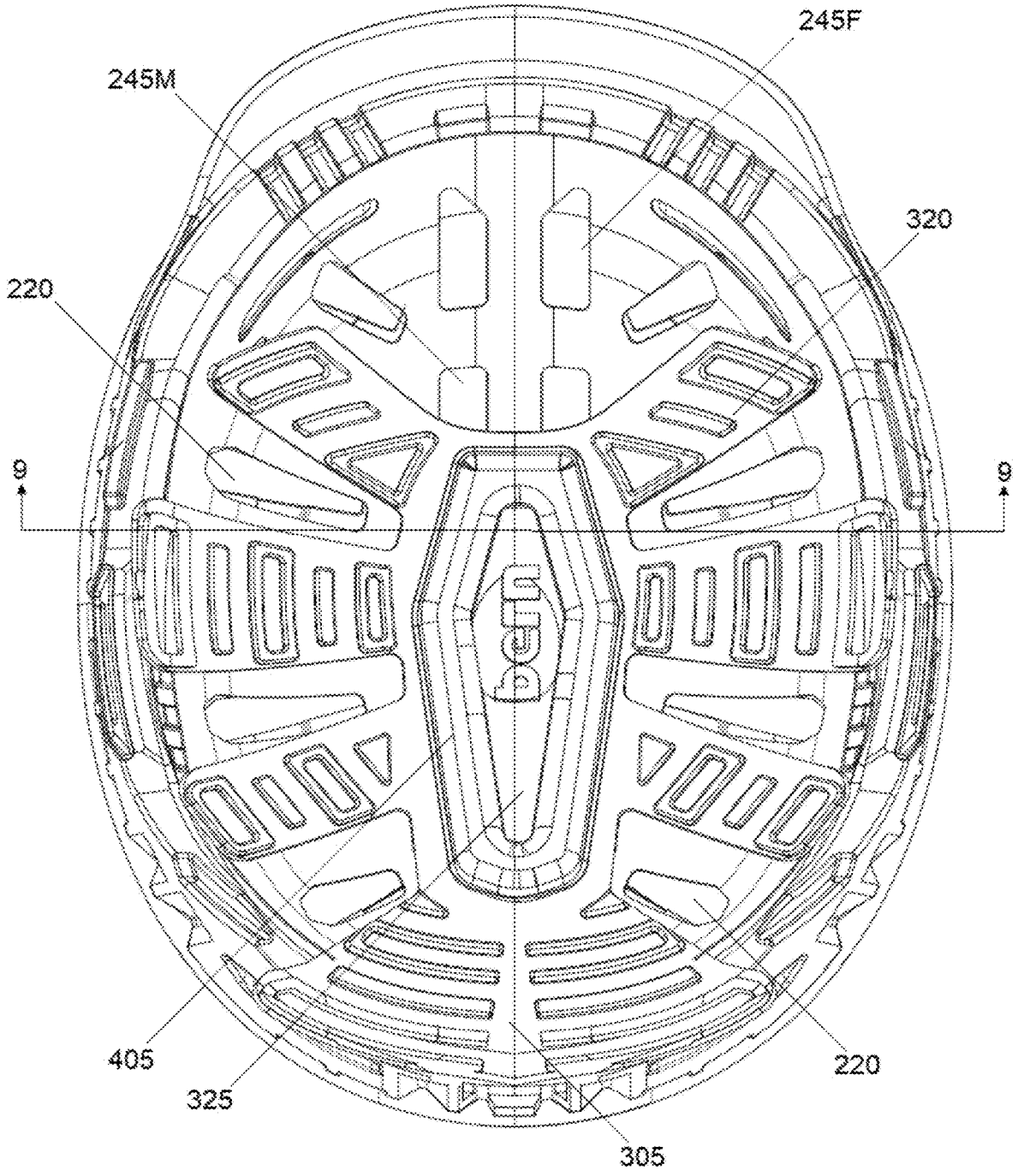
FIG. 7 illustrates a ventilation control of the helmet of FIG. 1 disposed in an open position.
Figure 8:
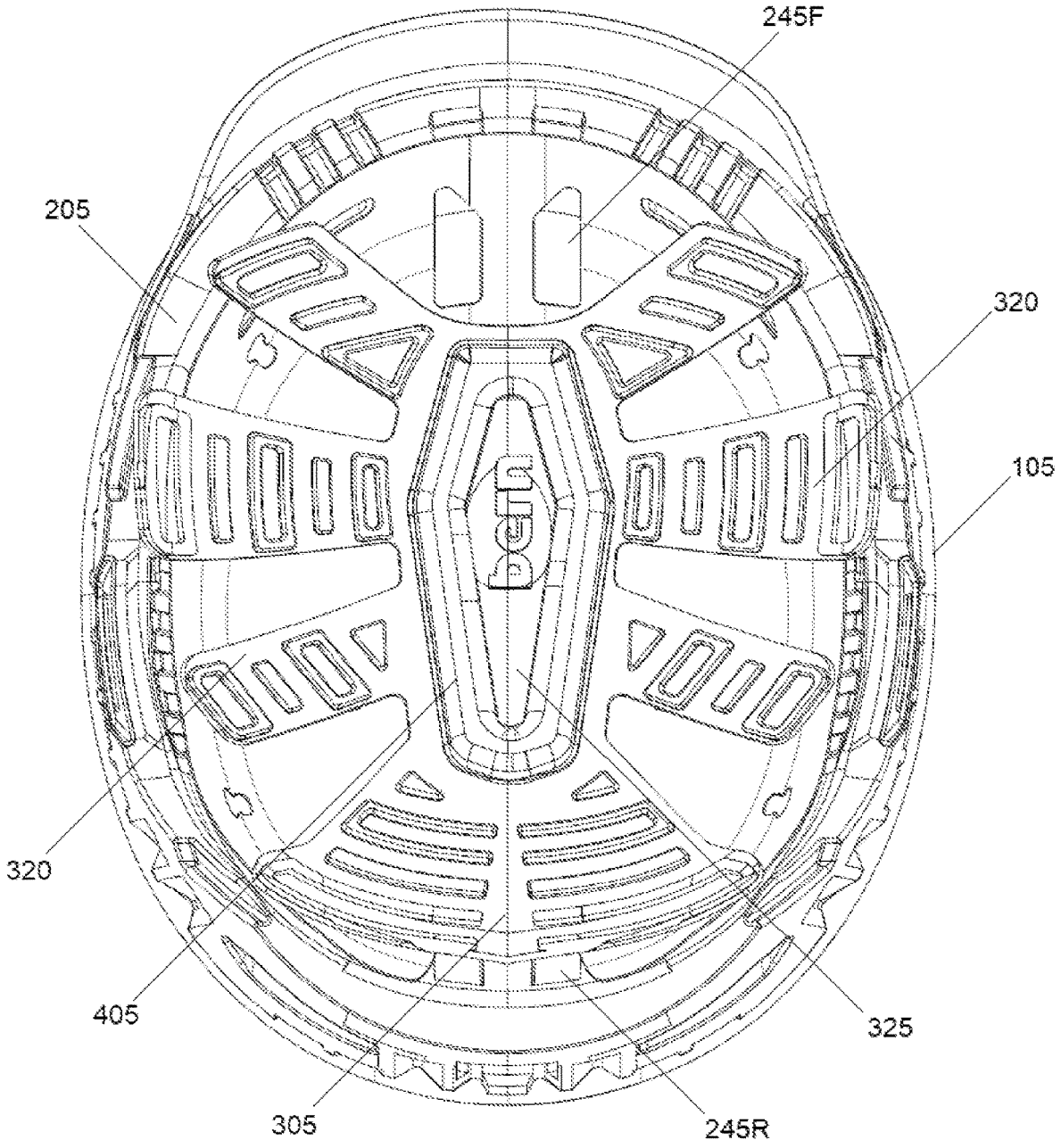
FIG. 8 illustrates the ventilation control of the helmet of FIG. 1 disposed in a closed position
Figure 9:
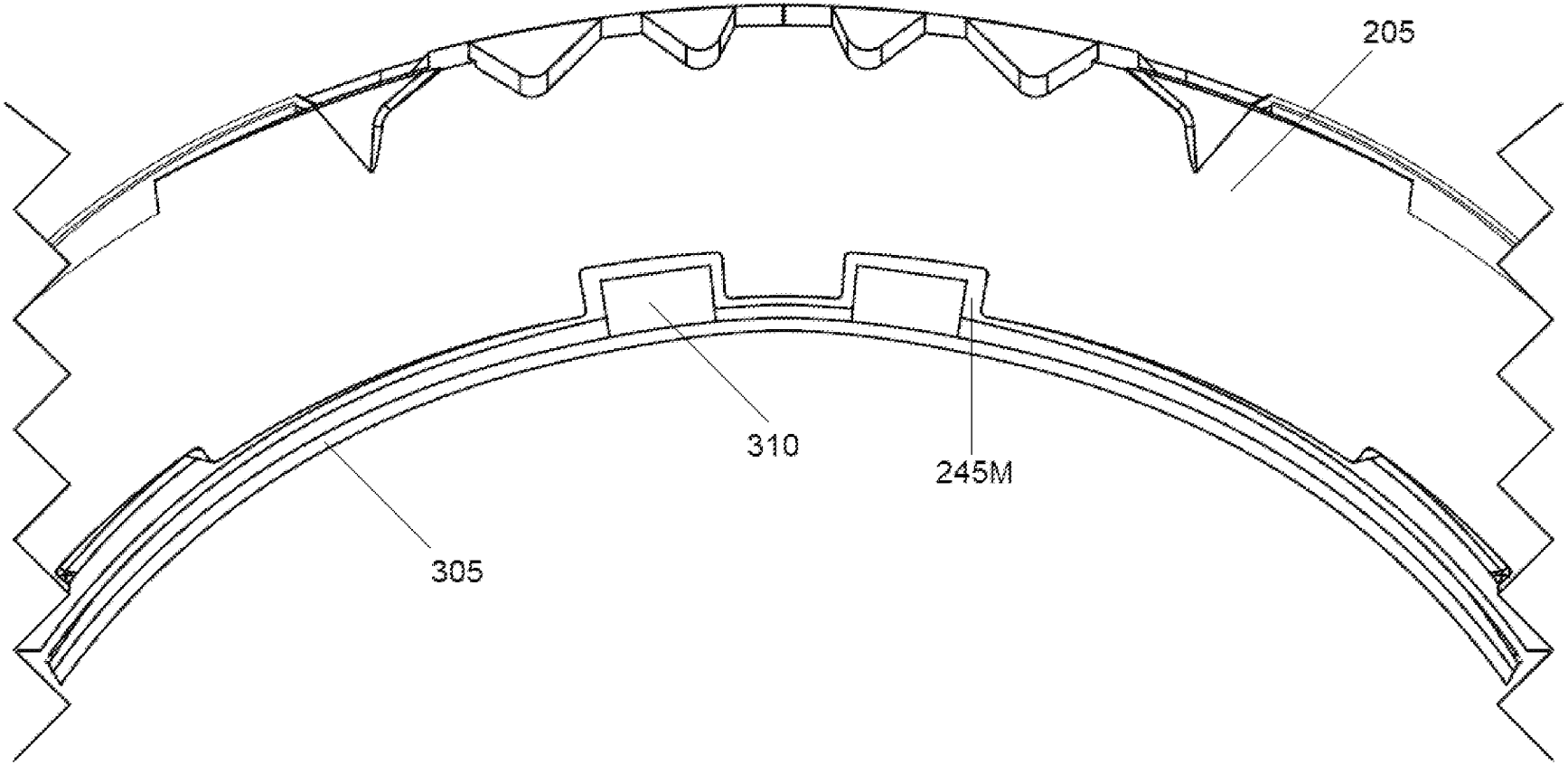
FIG. 9 is a cross-sectional view of a portion of an embodiment of a helmet.

FIG. 7 illustrates the slider plate 305 and bosses 310 (not visible because covered by the slider plate) mounted to the internal surface of the inner liner 205. The slider plate 305 is disposed in a position in which the petals 320 do not obstruct or at least do not substantially block the top apertures 220 so that air may flow through the top apertures, as well as the top apertures 120 of the shell 105 (not shown in FIGS. 7 and 8.) FIG. 8 illustrates the slider plate 305 and bosses 310 after sliding through the recessed tracks 245 into a position in which the petals 320 of the slider plate 305 block the top apertures 220 to prevent air may flow through the top apertures, as well as the top apertures 120 of the shell 105. The slider plate 305 may leave both the front and rear apertures 125, 225, 130, 230 unobstructed while blocking the top apertures 120, 220. It is to be understood that when the slider plate is in the position shown in FIG. 8 the seal of the petals 320 on the top apertures 120, 220 may not be perfectly hermetic and some air may leak through the top apertures 120, 220, but the top apertures 120, 220 may still be considered blocked or obstructed by the petals 320. The range of motion of the slider plate 305 along the recessed tracks 245 may be limited to within the rearward and forward positions illustrated in FIGS. 7 and 8 by either stops disposed in the recessed tracks 245 against which the bosses 310 may abut at either end of the range of motion, by portions of the inner liner 205 or shell 105 that one or more petals 320 of the slider plate 305 may abut at either end of the range of motion, or by the geometry of the recessed tracks 245 themselves.

As discussed briefly above, a user may manually displace the slider plate 305 along the recessed tracks 245 to one of the positions shown in FIG. 7 or FIG. 8 to open or block the top apertures 120, 220, or to a position partially between one of the positions shown in FIG. 7 or FIG. 8 to partially block the top apertures 120, 220. The bosses 310 are retained in the recessed tracks 245 with sufficient friction to allow a user to move the slider plate 305 along the recessed tracks 245 with the user's hand and without the use of tools, but that the slider plate 305 remains in position along the recessed tracks 245 in the absence of user manipulation. There is no need for any locking mechanism to hold the bosses 310 and slider plate 305 in a selected position along the recessed tracks 245. The user may move the slider plate 305 along the recessed tracks 245 by pushing the slider plate 305 along the recessed tracks 245 inside the volume of the helmet 100. There is no need for any mechanism to extend outside the shell 105 of the helmet 100 to enable repositioning of the slider plate 305 along the recessed tracks 245.

In some embodiments, the helmet 100 may include additional features not shown, for example, one or more straps attached to various portions of the helmet 100 which may be utilized to secure the helmet 100 to the head of a wearer when in use.

Having thus described several aspects of at least one embodiment of this invention, it is to be appreciated various alterations, modifications, and improvements will readily occur to those skilled in the art. Any feature described in any embodiment may be included in or substituted for any feature of any other embodiment. Such alterations, modifications, and improvements are intended to be part of this disclosure, and are intended to be within the scope of the invention. Accordingly, the foregoing description and drawings are by way of example only.

What is claimed is:

1. A helmet comprising:

a shell including an outer surface and an inner surface, the shell defining a shell ventilation aperture passing from the outer surface of the shell to the inner surface of the shell;

an inner liner securable within the shell, the inner liner defining an inner liner ventilation aperture that aligns with the shell ventilation aperture when the inner liner is secured within the shell, the inner liner further defining a recessed track in an inner surface of the inner liner; and a ventilation control including a slider plate and a boss disposed on an upper surface of the slider plate, the boss configured to frictionally engage the recessed track and to be reversibly displaced along the recessed track from a first position in which the slider plate blocks a flow of air through the inner liner ventilation aperture to a second position in which the slider plate permits the flow of air through the inner liner ventilation aperture, the slider plate configured to be reversibly displaced between the first position and the second position by a force applied upon a lower surface of the slider plate from within an internal volume of the helmet.

2. The helmet of claim 1, wherein the slider plate is not displaceable between the first and second positions from outside of the helmet.

3. The helmet of claim 2, wherein the ventilation control is configured to maintain a position in one of the first position, the second position, and an intermediate position between the first position and the second position in the absence of a force applied by a user of the helmet to the slider plate.

4. The helmet of claim 1, wherein the shell and inner liner each include a plurality of air flow apertures, the plurality of air flow apertures of the shell being aligned with the plurality of air flow apertures of the inner liner when the inner liner is secured within the shell.

5. The helmet of claim 4, wherein the slider plate includes a plurality of petals, the plurality of petals configured to block air flow through a subset of the plurality of air flow apertures of the inner liner when the slider plate is disposed in the first position.

6. The helmet of claim 5, wherein the recessed track runs in a direction from a front to a back of the internal liner.

7. The helmet of claim 5, wherein a range of motion of the slider plate along the recessed track is limited to within forward and rearward positions.

8. The helmet of claim 5, wherein the subset of the plurality of air flow apertures of the inner liner include air flow apertures disposed on a top portion of the helmet.

9. The helmet of claim 8, wherein the shell and inner liner each include front and rear air flow apertures, the front and rear air flow apertures of the shell being aligned with the front and rear air flow apertures of the inner liner when the inner liner is secured within the shell, the front and rear air flow apertures of the inner shell permitting flow of air through the helmet when the slider plate is disposed in the first position.

10. The helmet of claim 1, further comprising a cushion disposed on the lower surface of the slider plate.

11. The helmet of claim 1, wherein the inner liner further defines a second recessed track in the inner surface of the inner liner and the slider plate includes a plurality of bosses disposed on the upper surface of the slider plate, a first subset of the plurality of bosses configured to be frictionally retained within the recessed track and a second subset of the plurality of bosses configured to be frictionally retained within the second recessed track.

12. The helmet of claim 1, wherein the inner liner comprises a plurality of ribs defining a plurality of air flow channels configured to provide paths for air flow through the helmet.

13. The helmet of claim 12, wherein the plurality of air flow channels are configured to provide paths for air flow through the helmet in both a front to rear direction and a side to side direction.

14. The helmet of claim 13, wherein the plurality of ribs are aligned along both the front to rear direction and the side to side direction.

15. The helmet of claim 12, further wherein the plurality of air flow channels include air flow channels disposed in a lower front surface of the inner liner and configured to draw air from goggles worn by a user of the helmet while the user wears both the goggles and helmet.

16. The helmet of claim 1, wherein the recessed track is a recessed portion of the internal side of the inner liner that is sized to receive the boss.

17. The helmet of claim 1, wherein the boss is further configured to form a friction fit within the recessed track that keeps the slider plate engaged with the internal liner.

18. A ventilation control system for a helmet, the ventilation control system comprising a slider plate and a boss disposed on an upper surface of the slider plate, the boss configured to frictionally engage a recessed track defined within an inner surface of a liner of the helmet and to be reversibly displaced along the recessed track from a first position in which the slider plate blocks a flow of air through a ventilation aperture defined in the inner liner to a second position in which the slider plate permits the flow of air through the ventilation aperture, the slider plate configured to be reversibly displaced between the first position and the second position by a force applied upon a lower surface of the slider plate from within an internal volume of the helmet.

* * * * *